US008967397B1

(12) United States Patent
Greenwald

(10) Patent No.: US 8,967,397 B1
(45) Date of Patent: Mar. 3, 2015

(54) DEVICE AND SYSTEM FOR SECURING SPORTS EQUIPMENT

(76) Inventor: Michael Edward Greenwald, Santa Cruz, CA (US)

( * ) Notice: Subject to any disclaimer, the term of this patent is extended or adjusted under 35 U.S.C. 154(b) by 342 days.

(21) Appl. No.: 12/957,296

(22) Filed: Nov. 30, 2010

Related U.S. Application Data

(60) Provisional application No. 61/265,684, filed on Dec. 1, 2009.

(51) Int. Cl.
*A47F 7/00* (2006.01)

(52) U.S. Cl.
USPC ..... 211/85.7; 211/4

(58) Field of Classification Search
CPC .... A63C 11/028; A63C 11/02; A63C 11/008; A63C 11/007; A63C 11/021; A63C 2203/44; A63B 71/036; A47B 81/00; E05B 73/00; E05B 73/0094; E05B 73/007; E05B 67/383; G07F 17/10
USPC ..... 211/4, 5, 85.7, 72, 71.01, 70.5, 8, 22, 211/20, 84, 83, 82, 81, 24; D12/115; 312/327, 329, 245, 290
See application file for complete search history.

(56) References Cited

U.S. PATENT DOCUMENTS 2,046,815 A * 7/1936 Fike ..... 70/61
3,275,160 A * 9/1966 Zurker ..... 211/70.5
3,604,228 A * 9/1971 Conlon ..... 70/58
3,836,058 A * 9/1974 Penniman et al. ..... 224/315
4,155,458 A * 5/1979 Moline ..... 211/4
4,222,490 A * 9/1980 Wood, Jr. ..... 211/70.5
4,433,787 A * 2/1984 Cook et al. ..... 211/5
4,473,176 A * 9/1984 Harper ..... 224/569
4,494,805 A * 1/1985 Washburn ..... 312/215
4,807,453 A * 2/1989 Bernier et al. ..... 70/233
5,014,955 A * 5/1991 Thompson ..... 248/309.1
5,120,012 A * 6/1992 Rosenau ..... 248/201
5,147,049 A * 9/1992 Schwendemann et al. .. 211/70.5
5,244,101 A * 9/1993 Palmer et al. ..... 211/5
5,477,968 A * 12/1995 Largent et al. ..... 211/60.1
5,582,044 A * 12/1996 Bolich ..... 70/58
5,675,999 A * 10/1997 Carlstrom ..... 70/18
5,706,680 A * 1/1998 Wroble ..... 70/18
5,802,887 A * 9/1998 Beland ..... 70/14

(Continued)

OTHER PUBLICATIONS http://www.boardloch.com/index.html. 1 page.

(Continued)

*Primary Examiner* — Patrick Hawn
(74) *Attorney, Agent, or Firm* — Haverstock & Owens LLP

(57) ABSTRACT

A device for securing sports equipment comprises a supporting structure, a body for housing the sports equipment coupled to the supporting structure, and a securing mechanism for securing the sports equipment in the body, wherein a portion of the sports equipment protrudes from the body when it is secured within the body. In some embodiments, the securing mechanism is integrally coupled to the body and rotates between an open position and a closed position about a hinge. In some embodiments the device further comprises a lock hole for an external lock. In some embodiments, the device further comprises a lock integrally attached to the body. In some embodiments, the securing mechanism covers a protruding portion of the sports equipment. In some embodiments, the sports equipment comprises one or more of a skateboard, a long board skateboard, a snowboard, a scooter, and skis.

10 Claims, 9 Drawing Sheets

(56) References Cited

U.S. PATENT DOCUMENTS

| | | | | |
|---|---|---|---|---|
| 5,833,078 | A * | 11/1998 | York | 211/70.5 |
| 5,901,588 | A * | 5/1999 | Frost | 70/39 |
| 6,244,616 | B1 * | 6/2001 | Arduin et al. | 280/602 |
| 6,263,709 | B1 * | 7/2001 | Kemery et al. | 70/14 |
| 6,293,412 | B1 * | 9/2001 | Draper | 211/4 |
| 6,412,807 | B1 * | 7/2002 | Arduin et al. | 280/607 |
| 6,431,578 | B2 * | 8/2002 | Pedersen et al. | 280/626 |
| 6,471,235 | B1 * | 10/2002 | Luitz et al. | 280/618 |
| 6,481,581 | B2 * | 11/2002 | Sipe | 211/4 |
| 6,640,978 | B2 * | 11/2003 | Reiser et al. | 211/4 |
| 6,978,902 | B2 | 12/2005 | Loch | |
| 7,024,894 | B2 * | 4/2006 | Salonen | 70/58 |
| 7,318,530 | B2 | 1/2008 | Loch | |
| 7,549,307 | B2 * | 6/2009 | Bistline | 70/18 |
| 2002/0179546 | A1 * | 12/2002 | McMurray et al. | 211/4 |
| 2003/0010735 | A1 * | 1/2003 | Wuerth | 211/85.7 |
| 2007/0125731 | A1 * | 6/2007 | Waterman | 211/85.7 |
| 2007/0164532 | A1 * | 7/2007 | Nemec et al. | 280/202 |
| 2007/0235400 | A1 * | 10/2007 | Wald | 211/85.7 |

OTHER PUBLICATIONS http://www.madrax.com/Default.aspx?tabid=61 &txtSearch=BB158&List=List=0 &SortField=ProductName%2CProductName&ProductID=43. 1 page.

http://www.bikeracks.com/html/skbd.html, pp. 1-2.

* cited by examiner

DEVICE AND SYSTEM FOR SECURING SPORTS EQUIPMENT

RELATED APPLICATIONS

The present application claims priority of U.S. Provisional Patent App. No. 61/265,684, filed Dec. 1, 2009 and entitled SKATEBOARD LOCKERS, which is incorporated herein by reference.

FIELD OF THE INVENTION

This invention relates generally to storage devices and lockers. More specifically, this invention relates to storage devices and lockers for securely storing sports equipment.

BACKGROUND OF THE INVENTION

Bicycles, scooters, and skateboards are often used as a means of transportation. Board sports such as skateboarding, long board skateboarding, snowboarding, skiing, and scooter riding have increasingly become popular in the last couple of decades. Many of these items have also become a common means of transportation and are regularly used in public spaces. Typically, when a bike rider has reached their destination, they are able to secure the bike by passing a lock through the frame or wheels of the bike and locking it to a rack or other object. However, skateboards, long board skateboards, snowboards, skis, and scooters are not able to be secured in this manner due to their configuration. Consequently, after reaching a destination, a user is forced to carry the sports equipment with them or leave it in an unsecured location where it may be lost or stolen.

SUMMARY OF THE INVENTION

In one aspect, a device for securing sports equipment comprises a supporting structure, a body for housing the sports equipment coupled to the supporting structure, and a securing mechanism for securing the sports equipment in the body, wherein a portion of the sports equipment protrudes from the body when it is secured within the body. In some embodiments, the securing mechanism is integrally coupled to the body and rotates between an open position and a closed position about a hinge. In some embodiments the device further comprises a lock hole for an external lock. In some embodiments, the device further comprises a lock integrally attached to the body. In some embodiments, the portion of the sports equipment that protrudes from the body, protrudes through a space of the body. In some embodiments, the securing mechanism covers a protruding portion of the sports equipment. In some embodiments, the supporting structure is a mounting stand coupled to a ground. In further embodiments, the supporting structure is a mounting stand coupled to an object. In some embodiments the body comprises one or more of wood, steel, plastic, fiberglass and a combination thereof. In some embodiments, the sports equipment comprises one or more of a skateboard, a long board skateboard, a snowboard, a scooter, and skis.

In another aspect, a system for securing one or more item of sports equipment comprises a mounting base, a locker body coupled to the mounting base, wherein a portion of the sports equipment protrudes from the locker body when secured within the locker body, and one or more additional locker body coupled to the mounting base. In some embodiments the system further comprises one or more additional mounting base. In some embodiments, the sports equipment is secured by a securing mechanism that is coupled to the locker body and rotates between an open position and a closed position about a hinge. In some embodiments, wherein the locker body and the one or more additional locker body comprise a lock. In some embodiments, the portion of the sports equipment that protrudes from the locker body, protrudes through a space of the locker body. In further embodiments, the securing mechanism covers a protruding portion of the sports equipment. In some embodiments, the body comprises one or more of wood, steel, plastic, fiberglass and a combination thereof. In some embodiments, the sports equipment comprises one or more of a skateboard, a long board skateboard, a snowboard, a scooter, and skis.

In a further aspect, a method of securing sports equipment comprises placing the sports equipment within a locker, and closing a securing mechanism over a protruding portion of the sports equipment. In some embodiments, when the securing mechanism is closed a portion of the sports equipment protrudes from the locker. In some embodiments, the locker comprises a lock. In some embodiments, the portion of the sports equipment that protrudes from the locker body, protrudes through a space of the locker. In some embodiments, the sports equipment comprises one or more of a skateboard, a long board skateboard, a snowboard, a scooter, and skis.

DETAILED DESCRIPTION

In the following description, numerous details are set forth for purposes of explanation. However, one of ordinary skill in the art will realize that the invention may be practiced without the use of these specific details or with equivalent alternatives. Thus, the present invention is not intended to be limited to the embodiments shown but is to be accorded the widest scope consistent with the principles and features described herein.

Reference will now be made in detail to implementations of the present invention as illustrated in the accompanying drawings. The same reference indicators will be used throughout the drawings and the following detailed description to refer to the same or like parts.

Figure 1:
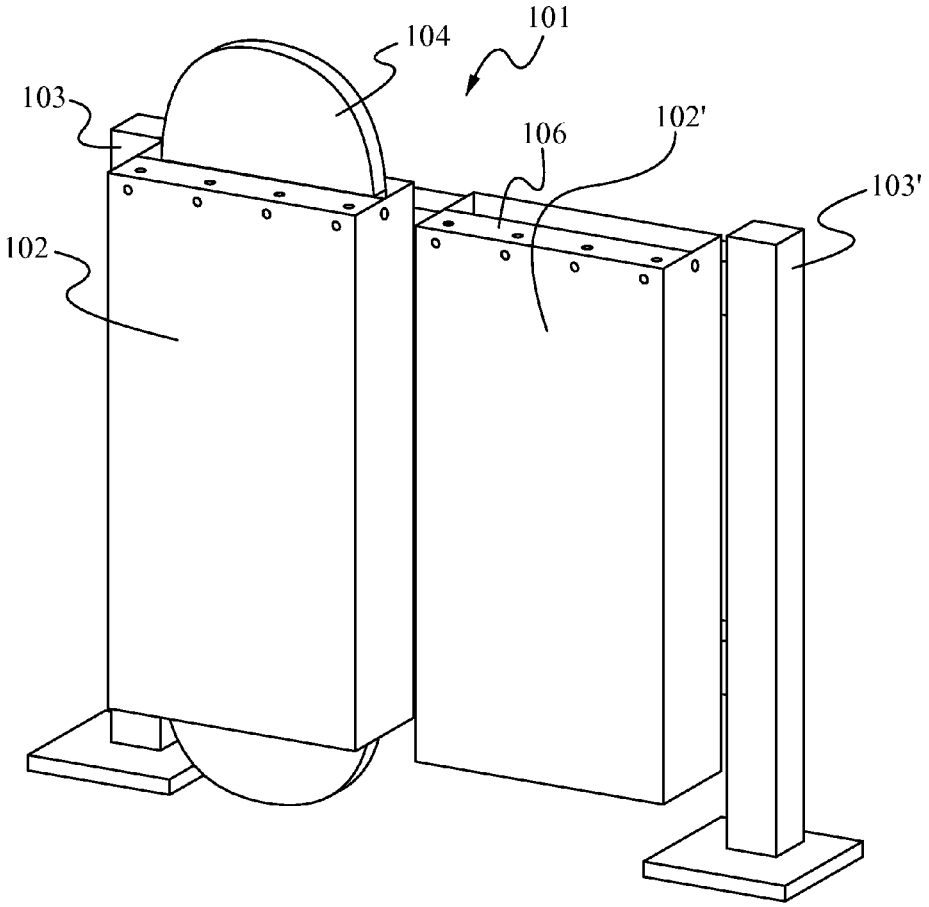
FIG. 1 illustrates a front view of a device for securing sports equipment in accordance with some embodiments.

Referring now to FIG. 1, a device for securing sports equipment 101 is depicted therein. The device for securing sports equipment 101 comprises a supporting structure 103, a body 102 for housing sports equipment 104 coupled to the supporting structure 103 and a securing mechanism 106 for securing the sports equipment 104 within the body 102. In some embodiments, the body 102 comprises a locker body. In some embodiments, the sports equipment 104 comprises a skateboard. In some embodiments, the sports equipment 104 comprises one or more of a long board skateboard, a scooter, snowboard and skis. Particularly, the sports equipment is able to comprise any sports equipment with substantially flat surface such as a board, and a protruding structure such as wheels or bindings which cannot be secured by a traditional u-lock or cable lock.

As shown in FIG. 1, when the skateboard 104 is secured within the body 102, a portion of the skateboard 104 protrudes from the body 102. In some embodiments, a portion of the skateboard 104 protrudes from a top portion and a bottom portion of the body 102. In some embodiments, the supporting structure 103 is a mounting stand. The mounting stand is used to secure the device 101 to the ground. In some embodiments, the supporting structure 103 secures the device 101 to a wall or other structure. In some embodiments, the device 101 comprises one or more of steel, sheet metal, wood, plastic, fiber glass, and a combination thereof. In some embodiments, the body 102 and the supporting structure 103 comprise injection molded plastic. In some embodiments, the body 102 is coupled to one or more additional bodies 102' and one or more additional supporting structures 103' for holding an additional skateboard or other sports equipment.

Figure 2:
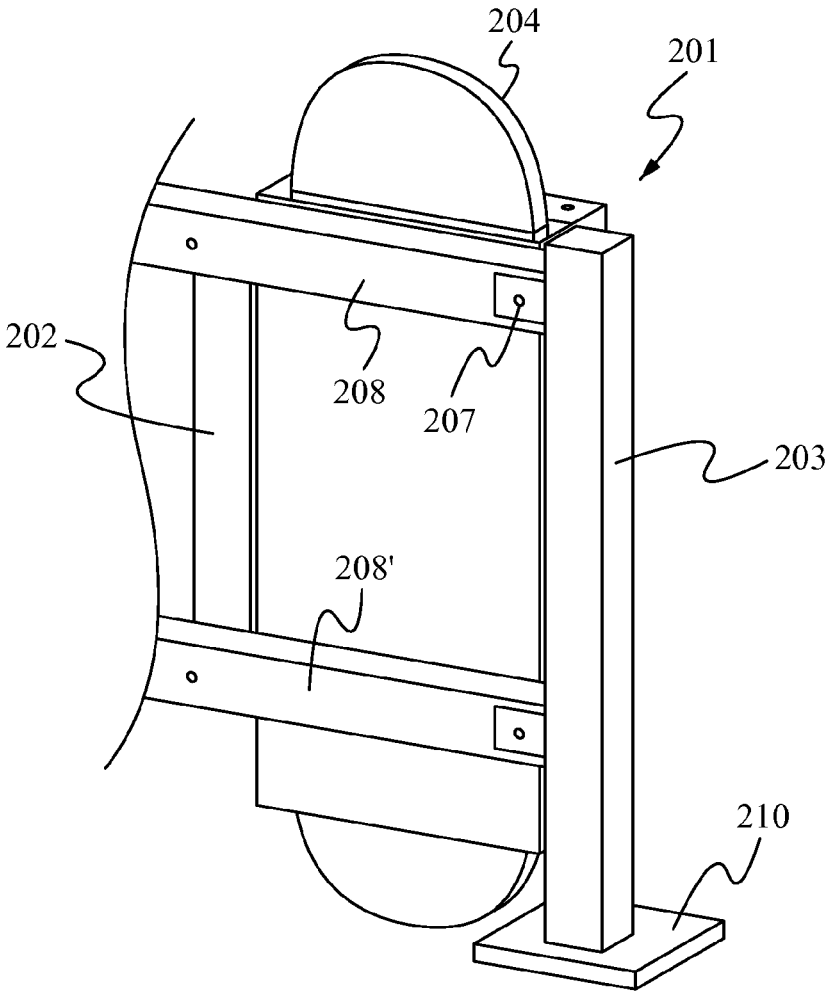
FIG. 2 illustrates a back view of a device for securing sports equipment in accordance with some embodiments.

FIG. 2 illustrates a back view of the device for securing sports equipment 201 in accordance with some embodiments. In some embodiments, the sports equipment 204 comprises a skateboard. The device 201 comprises one or more mounting channels 208 and 208', a supporting structure 203 and a body 202. As shown in FIG. 2, the one or more mounting channels 208 and 208' couple the body 202 to the supporting structure 203. In some embodiments, the one or more mounting channels 208 and 208' are coupled to the body and the supporting structure by one or more fasteners 207. In some embodiments, the one or more fasteners 207 comprise a stainless steel, button head, tamper proof, torx head screw and stainless steel nylock nut. However, the one or more fasteners 207 are able to comprise any fastening mechanism as known in the art. For example, in some embodiments, the one or more mounting channels 208 and 208' are coupled to the body 202 and the supporting structure 203 by one or more spot weld and rivet. In further embodiments, the one or more mounting channels 208 and 208' comprise a solid back panel. As also shown in FIG. 2, the supporting structure 203 comprises a base 210 for securing the supporting structure 203 and the body 202 to the ground.

Figure 3:
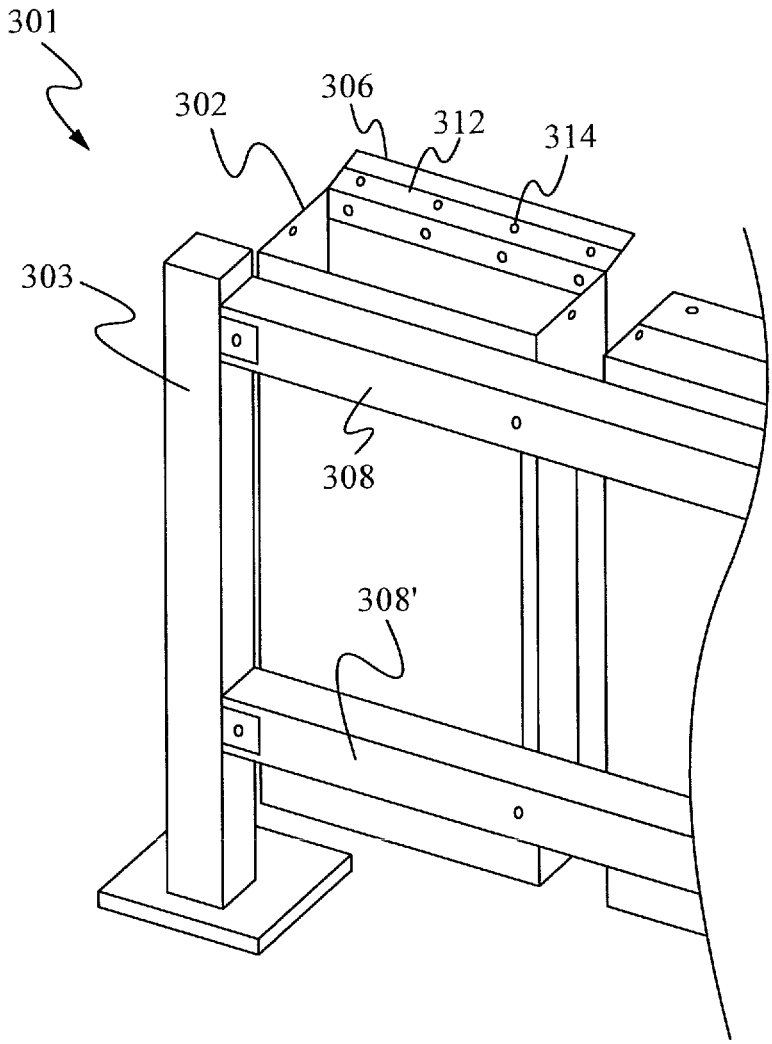
FIG. 3 illustrates a top perspective view of a device for securing sports equipment in an open configuration accordance with some embodiments.

FIG. 3 illustrates a top perspective view of a device 301 for securing sports equipment in an open configuration in accordance with some embodiments. The device 301 comprises one or more mounting channels 308 and 308', a supporting structure 303 and a body 302. As shown in FIG. 3, the securing mechanism 306 comprises a lid which rotates about a hinge 312 between an open position and a closed position. In some embodiments, the hinge 312 couples to the lid 306 and the body 302 by one or more fasteners 314. In some embodiments, the one or more fasteners 314 comprise a stainless steel, button head, tamper proof, torx head screw and stainless steel nylock nut. However, the one or more fasteners 314 are able to comprise any fastening mechanism as known in the art. For example, in some embodiments, the one or more fasteners 314 comprise one or more spot weld and rivet. The securing mechanism 306 moves from an open position to a closed position in order to secure the sports equipment (not shown) within the body 302.

Figure 8A:
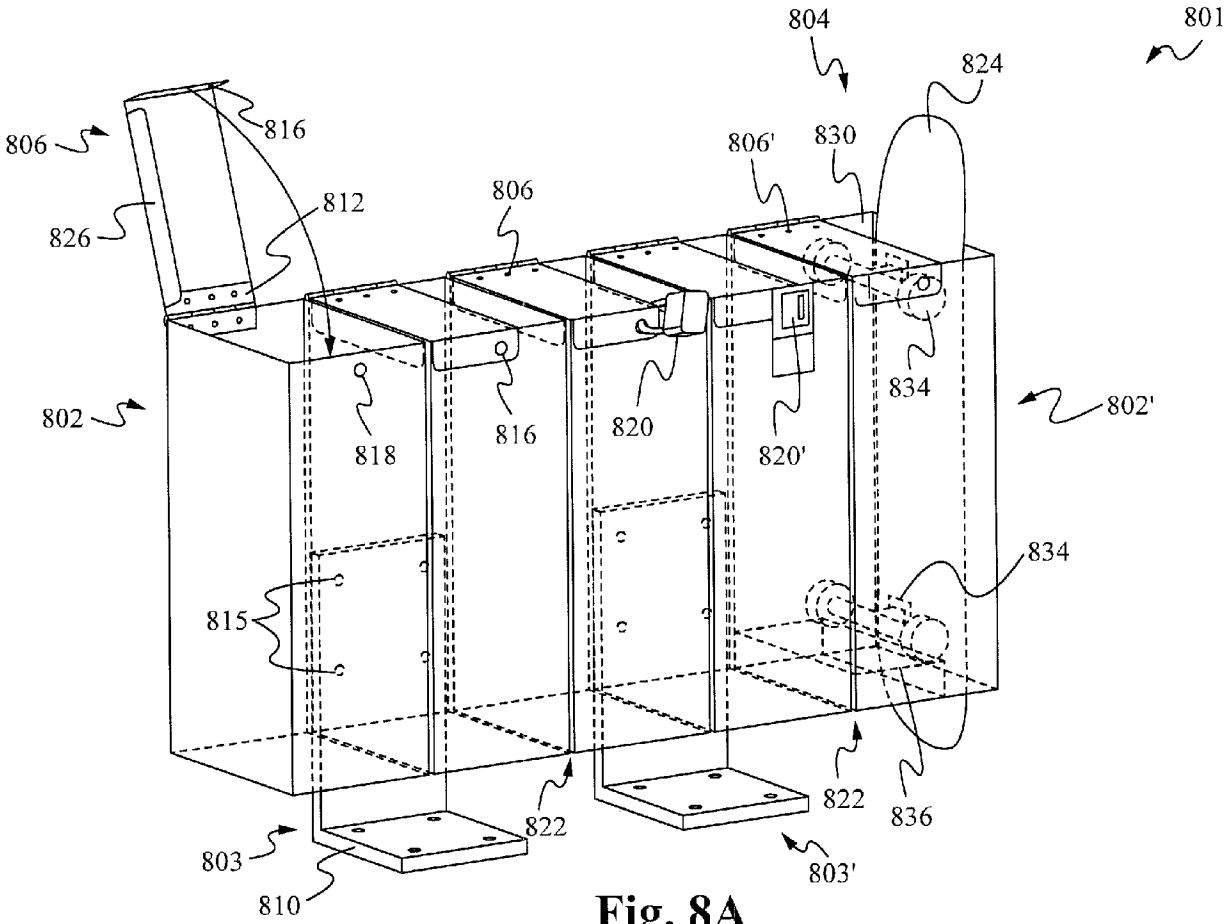
FIG. 8A illustrates a system for securing sports equipment in accordance with some embodiments.

As shown in FIG. 3, the securing mechanism 306 comprises a lid on the top of the body 302. However, as will be apparent to someone of ordinary skill in the art, the securing mechanism 306 is able to couple to any portion of the body 302. For example, in some embodiments the securing mechanism 306 couples to a front of the body 302 and opens in the same manner as a traditional locker door. In some embodiments, when the skateboard is placed within the body 302, a bottom portion of the skateboard or other sports equipment rests on the ground. Alternatively, when the skateboard or other sports equipment is placed within the body 302, a portion of the skateboard or other sports equipment is supported and/or suspended by an additional securing mechanism 836 as shown in FIG. 8A. In some embodiments, the additional securing mechanism 836 forms an integral lower part or shelf of the body 302. In some embodiments, the supported and/or suspended portion of the sports equipment is a wheel assembly. Alternatively, the supported and/or suspended portion is able to be any combination of a deck 424 and/or one or more protruding portions 434 that protrude from the deck 424 (see FIGS. 4A-4C and 8A). In some embodiments, the additional securing mechanism 836 is able to be positioned on the body 302 such that when the sports equipment is supported by the additional securing mechanism 836, the bottom of the sports equipment is elevated above the ground and any dirt or other objects thereon.

Figure 4A:
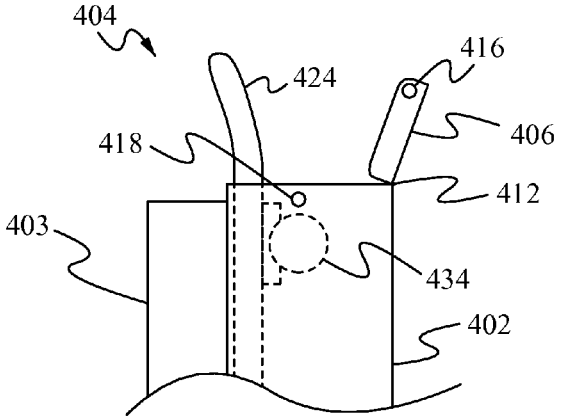
FIG. 4A illustrates a side view of a device for securing sports equipment in an open configuration accordance with some embodiments.

FIG. 4A illustrates a side view of a device for securing sports equipment in an open configuration in accordance with some embodiments. The device comprises a supporting mechanism 403, a body 402 coupled to the supporting mechanism 403, and a securing mechanism 406 in an open position. As shown in FIG. 4A, a skateboard 404 is positioned within the body 402. The skateboard 404 comprises a deck 424 and one or more protruding portions 434. In some embodiments, one or more of the protruding portions 434 are wheel assemblies. Alternatively, any other sports equipment as described above are able to replace the skateboard 404, wherein the other sports equipment comprises a deck and one or more protruding portions that protrude out from and are coupled to the deck. When the securing mechanism 406 is locked in a closed position, the securing mechanism 406 covers one or more of the protruding portions 434 of the skateboard 404 in order to securely hold the skateboard 404 within the device by blocking one or more of the protruding portions 434 from being removed from the top of the body 402. Alternatively, when the securing mechanism 406 is locked in the closed position, the securing mechanism 406 covers both the deck 424 and one or more of the protruding portions 434 thereby securely holding the skateboard 404 within the device by blocking both the deck 424 and one or more of the protruding portions 434 from being removed from the top of the body 402. It is understood that the skateboard 404 is able to be blocked from being removed from the bottom of the body 402 by the ground or other lower surface coupled to by the supporting mechanism 403. Alternatively, the additional securing mechanism 836 described above and shown in FIG. 8A is able to block one or more of the protruding portions 434 and/or the deck 424 from being removed from the bottom of the body 402. As further shown in FIG. 4A, in some embodiments, the securing mechanism 406 comprises a lock hole 416 which aligns with a lock hole 418 of the body 402 when the securing mechanism 406 is positioned in a closed position. As described above, the securing mechanism 406 rotates about a hinge 412 between an open position and a closed position.

Figure 4B:
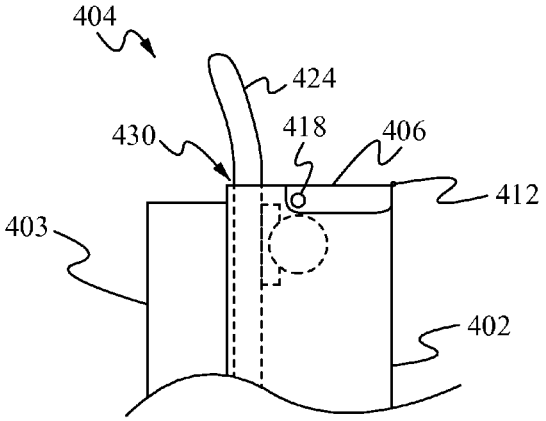
FIG. 4B illustrates a side view of a device for securing sports equipment in a closed configuration accordance with some embodiments.

FIG. 4B illustrates a side view of a device for securing sports equipment in a closed configuration in accordance with some embodiments. When the securing mechanism 406 is in a closed position, it covers at least one of the protruding portions (not shown) of the skateboard 404 making it impossible to remove the skateboard 404 from the locker body 402. In some embodiments, when the securing mechanism 406 is in a closed position, a portion of the skateboard 404 protrudes from a space/cavity 430 of the locker body 402. As shown in FIG. 4B, when the securing mechanism is in a closed position, the lock hole 416, as shown in FIG. 4A, aligns with the lock hole 418.

Figure 4C:
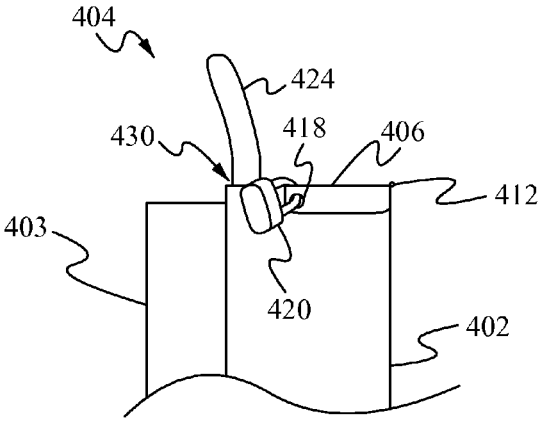
FIG. 4C illustrates a side view of a device for securing sports equipment in a closed configuration accordance with some embodiments.

FIG. 4C illustrates a side view of the skateboard 404 held within the locker body 402 of the device 401 and secured by a lock 420. The lock 420 is threaded through the lock hole 416 and the lock hole 418 in order to lock the securing mechanism 406 to the locker body 402 and keep the securing mechanism 406 in a closed position. As shown in FIG. 4C, the lock is a removable pad lock. In some embodiments, the lock 420 is integrally attached to the locker body 402. In further embodiments, the lock 420 is a coin operated lock.

Figure 5A:
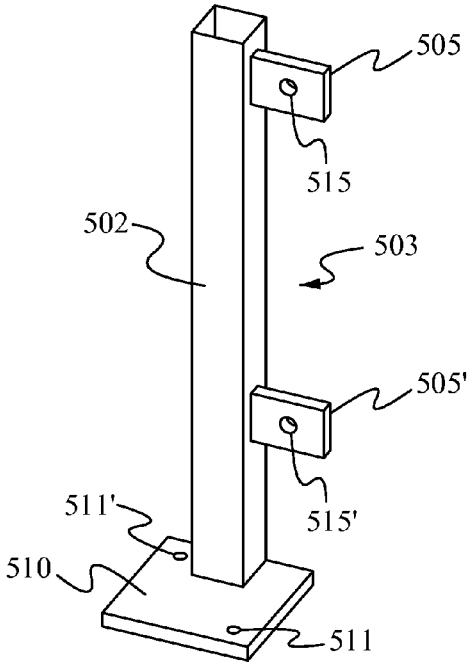
FIG. 5A illustrates a supporting structure of a device for securing sports equipment in accordance with some embodiments.

FIG. 5A illustrates a supporting structure 503 for use with a device for securing sports equipment in accordance with some embodiments. The supporting structure 503 comprises a vertical tube 502, a base 510 and one or more mounting tabs 505. In some embodiments, the supporting structure 503 comprises one or more of welded steel and galvanized steel. However, the supporting structure is able to comprise any material as known in the art. For example, in some embodiments, the supporting structure 503 comprises one or more of fiberglass, plastic and wood. In some embodiments, the supporting structure 503 comprises injection molded plastic. In some embodiments, the base 510 comprises one or more mounting holes 511 and 511' for mounting the base 510 and the supporting structure 503 to an object. In some embodiments the one or more mounting holes 511 and 511' mount the supporting structure 503 to the ground. In some embodiments, the one or more mounting holes 511 and 511', mount the supporting structure 503 to a wall. The one or more mounting tabs 505 comprise one or mounting holes 515 for coupling the supporting structure 503 to a locker body (not shown). In some embodiments, the supporting structure 503 comprises one or more additional mounting tabs 505' and one or more additional mounting holes 515'. The supporting structure 503 is able to couple to the locker body by any mechanism as known in the art. For example, in some embodiments, the supporting structure 503 couples to the locker body by one or more of spot welds, rivets, and push in studs. In some embodiments, the supporting structure 503 couples to the locker body by stainless steel, button head, tamper proof, torx head screw and stainless steel nylock nut. Additionally, in some embodiments, the supporting structure 503 couples to the locker body through one or more mounting channels, as described above.

Figure 5B:
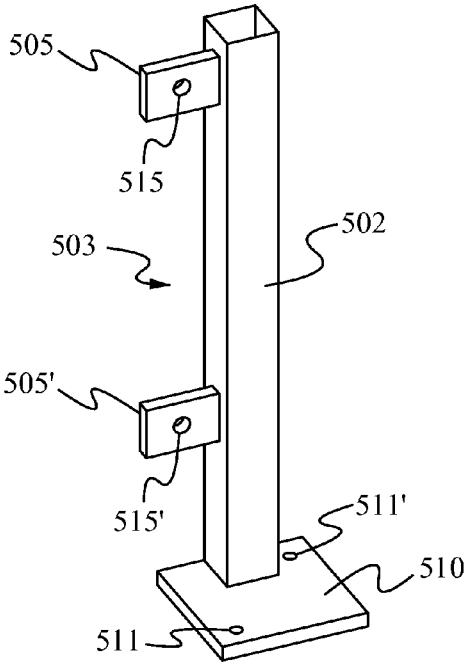
FIG. 5B illustrates a supporting structure of a device for securing sports equipment in accordance with some embodiments.

FIG. 5B illustrates a supporting structure 503 in accordance with further embodiments. The supporting structure 503 comprises a vertical tube 502, a base 510 and one or more mounting tabs 505. As shown in FIG. 5B, the one or more mounting tabs 505 are mounted on an opposite side of the body as the one or more mounting tabs 505 shown in FIG. 5A. As will be apparent to someone of ordinary skill in the art, the one or more mounting tabs 505 are able to be located at any position on the supporting structure 503. The one or more mounting tabs 505 comprise one or mounting holes 515 for coupling the supporting structure 503 to a locker body (not shown). In some embodiments, the supporting structure 503 comprises one or more additional mounting tabs 505' and one or more additional mounting holes 515'. As described above, the supporting structure 503 is able to couple to the locker body by any mechanism as known in the art.

Figure 5C:
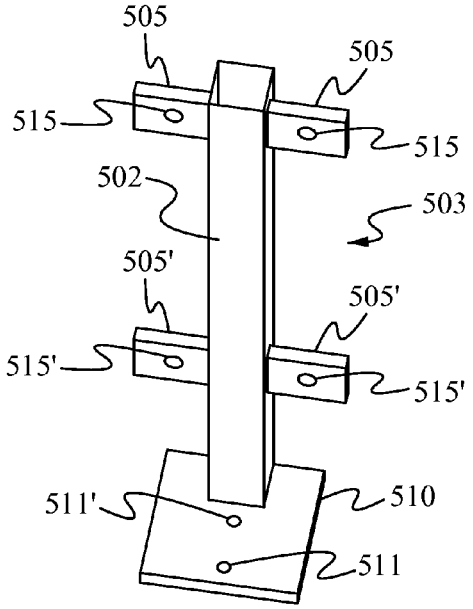
FIG. 5C illustrates a supporting structure of a device for securing sports equipment in accordance with some embodiments.

In further embodiments, the supporting structure 503 comprises one or more mounting tabs 505 on opposite sides of the supporting structure 503. FIG. 5C illustrates a supporting structure in accordance with further embodiments. The supporting structure 503 comprises a vertical tube 502, a base 510 and one or more mounting tabs 505 and one or more mounting holes 515 on opposite sides of the supporting structure 503. In some embodiments, the supporting structure 503 comprises one or more additional mounting tabs 505' and one or more additional mounting holes 515' on opposite sides of the supporting structure 503.

As shown in FIG. 5C, the base 510 comprises one or more mounting holes 511 and 511'. The one or more mounting holes 511 and 511' are centered on the base 510 from left to right. However, as will be apparent to someone of ordinary skill in the art, the mounting holes 511 and 511' are able to be implemented in any desired configuration.

Figure 6A:
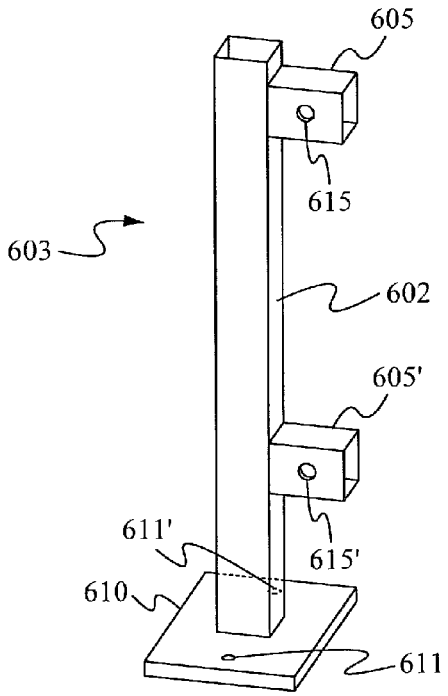
FIG. 6A illustrates a supporting structure of a device for securing sports equipment in accordance with some embodiments.

FIG. 6A illustrates a supporting structure 603 in accordance with further embodiments. The supporting structure 603 comprises a vertical tube 602, a base 610 and one or more mounting tabs 605 and mounting holes 615. The one or more mounting tabs 605 comprise one or more mounting holes 615 on each side of the mounting tabs' 605 body. Accordingly, in some embodiments, the one or more mounting tabs 605 are able to couple with a locker body (not shown) on each side of the mounting tabs 605. In some embodiments, the supporting structure 603 comprises one or more additional mounting tabs 605'. The base 610 comprises one or more holes 611 and 611' for mounting the supporting structure 603 to an object. In some embodiments, the base 610 secures the supporting structure 603 to the ground. As shown in FIG. 6A, the one or more holes 611 and 611' are positioned on opposite ends of the base 610. However, as will be apparent to someone of ordinary skill in the art, the one or more holes 611 and 611' are able to be positioned in any configuration.

Figure 6B:
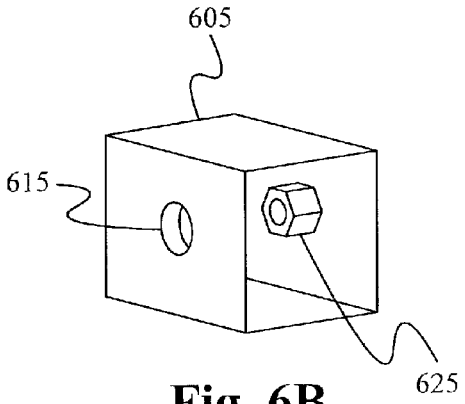
FIG. 6B illustrates a close-up view of a mounting tab in accordance with some embodiments.

FIG. 6B illustrates a close-up view of a mounting tab 605 comprising one or more mounting holes 615. As shown in FIG. 6B, the one or more mounting holes 615 comprise a threaded backer 625. In some embodiments, the threaded backer is welded to the inside of the one or more mounting tabs 605. In some embodiments, the supporting structure 603 couples to a locker body (not shown) by a screw threaded through the locker body and the mounting hole 615 and into the threaded backer 625.

Figure 6C:
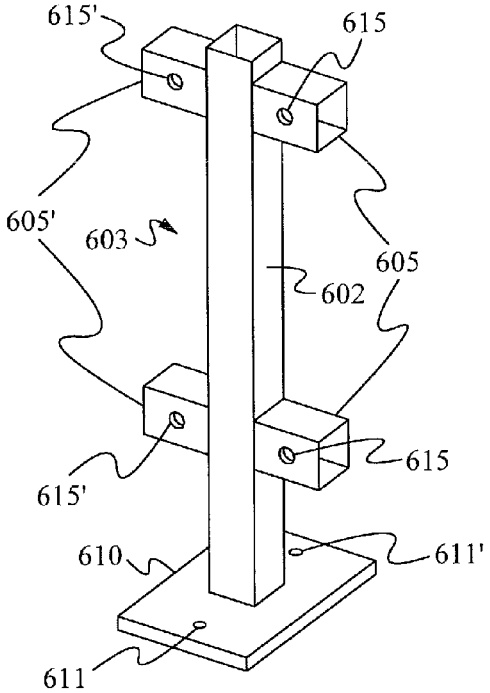
FIG. 6C illustrates a supporting structure of a device for securing sports equipment in accordance with some embodiments.

In further embodiments, the supporting structure 603 comprises one or more mounting tabs 605 and 605' on opposite sides of the supporting structure 603. FIG. 6C illustrates a supporting structure in accordance with further embodiments. The supporting structure 603 comprises a vertical tube 602, a base 610 and one or more mounting tabs 605 and 605' and one or more mounting holes 615 and 615' on opposite sides of the supporting structure 603. As shown in FIG. 6C, the base 610 comprises one or more mounting holes 611 and 611'. The one or more holes 611 and 611' are positioned on opposite ends of the base 610. However, as will be apparent to someone of ordinary skill in the art, the one or more holes 611 and 611' are able to be positioned in any configuration.

Figure 7:
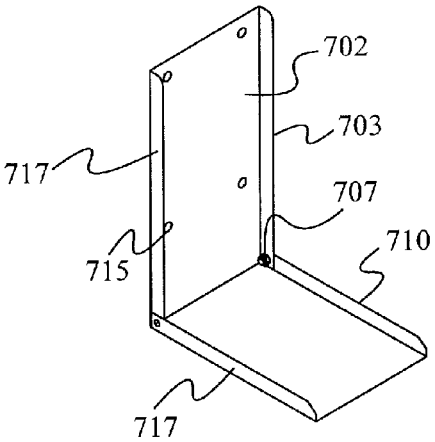
FIG. 7 illustrates a supporting structure of a device for securing sports equipment in accordance with some embodiments.

FIG. 7 illustrates a supporting structure 703 in accordance with some embodiments. The mounting base 703 comprises a vertical section 702 and a base 710. In some embodiments, the base 710 and vertical section 702 comprise a flange 717 for adding strength to the base 710 and the vertical section 717. In some embodiments, the vertical section 702 comprises one or more mounting holes 715 for coupling the supporting structure 703 with a locker body, as described above. In some embodiments, the vertical section 702 and the base 710 comprise metal and sheet metal. In some embodiments the vertical section 702 and the base 710 comprise one piece of bended metal. In further embodiments, the vertical section 702 is coupled to the base 710 by a fastener 707.

FIG. 8A illustrates a system for securing sports equipment 801 in accordance with some embodiments. The system 801 comprises a mounting base 803, a locker body 802 coupled to the mounting base 803 and one or more additional locker bodies 802' coupled to the mounting base 803. In some embodiments, the mounting base 803 comprises a supporting structure, as described above. In some embodiments, the system further comprises one or more additional mounting bases 803'.

As shown in FIG. 8A, in some embodiments, a locker body 802' removably holds a skateboard 804. In some embodiments, the locker bodies 802' removably holds one or more of a long board skateboard, a pair of skis, a snowboard, and a scooter. In some embodiments, when the skateboard 804 is secured within the locker body 802 a portion of the skateboard protrudes from the locker body 802. In some embodiments, the deck 824 of the skateboard 804 protrudes from a space 830 of the locker body 802. As shown within FIG. 8A, when the skateboard 804 is secured within the locker body 802, a securing mechanism 806' covers one or more of the protruding portions 834 of the skateboard 804 to prevent the skateboard 804 from being removed.

In some embodiments, the securing mechanism 806 is a lid, which is coupled to a top of the locker body 802 and rotates between an open position and a closed position by a hinge 812. However, the securing mechanism 806 is able to couple to the locker body 802 by any mechanism as known in the art. In some embodiments, the securing mechanism 806 comprises one or more flaps 826. In some embodiments, the securing mechanism 806 comprises a lock hole 816 which aligns with a lock hole 818 of the locker body 802 when the securing mechanism 806 is positioned in a closed position. Accordingly, in some embodiments, a lock 820 is able to be used to lock the securing mechanism 806 in a closed position. The lock 820 is threaded through the lock hole 816 and the lock hole 818 in order to lock the securing mechanism 806 to the locker body 802 and lock the securing mechanism 806 in a closed position. In some embodiments, the lock 820 is a removable pad lock. In some embodiments, a lock 820' is integrally attached to the locker body 802. As shown in FIG. 8A, in further embodiments, the lock 820' is a coin operated lock.

As shown in FIG. 8A, the system 801 comprises a locker body 802 and one or more additional locker bodies 802' which are separated by one or more dividers 822. Additionally, the system comprises a mounting base 803 and one or more additional mounting base 803'. In some embodiments, the mounting base 803 comprises one or more mounting holes 815 for coupling the mounting base 803 with the locker body 802. As will be apparent to someone of ordinary skill in the art, the system 801 is able to comprise any number of lockers and mounting bases depending on the desired application.

Figure 8B:
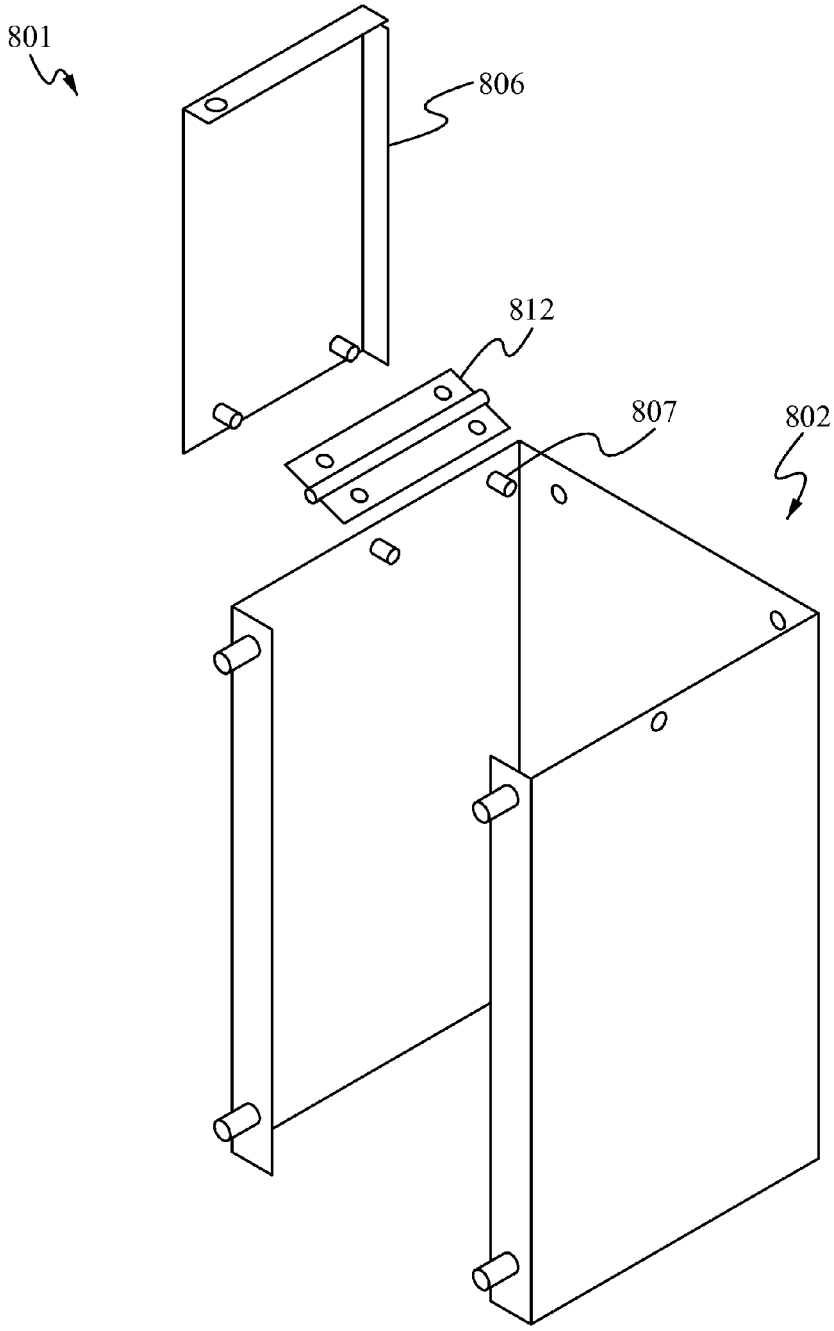
FIG. 8B illustrates an exploded view of a device for securing sports equipment in accordance with some embodiments.

FIG. 8B illustrates an exploded view of a device for securing sports equipment 801 in accordance with some embodiments. The device 801 comprises a locker body 802, a hinge 812, and a securing mechanism 806. In some embodiments, the locker body 802, the hinge 812, and the securing mechanism 806 are coupled by one or more fasteners 807. In some embodiments, the one or more fasteners 807 comprise press-in studs. In some embodiments, the one or more fasteners comprise stainless steel, button head, tamper proof, torx head screw and stainless steel nylock nut. However, the one or more fasteners 807 are able to comprise any fastening mechanism as known in the art. For example, in some embodiments, the one or more fasteners 807 comprise one or more spot weld and rivet. In some embodiments, the one or more fasteners 807 couple the locker body 802 to the one or more additional locker bodies 802' as shown in FIG. 8A.

Figure 9:
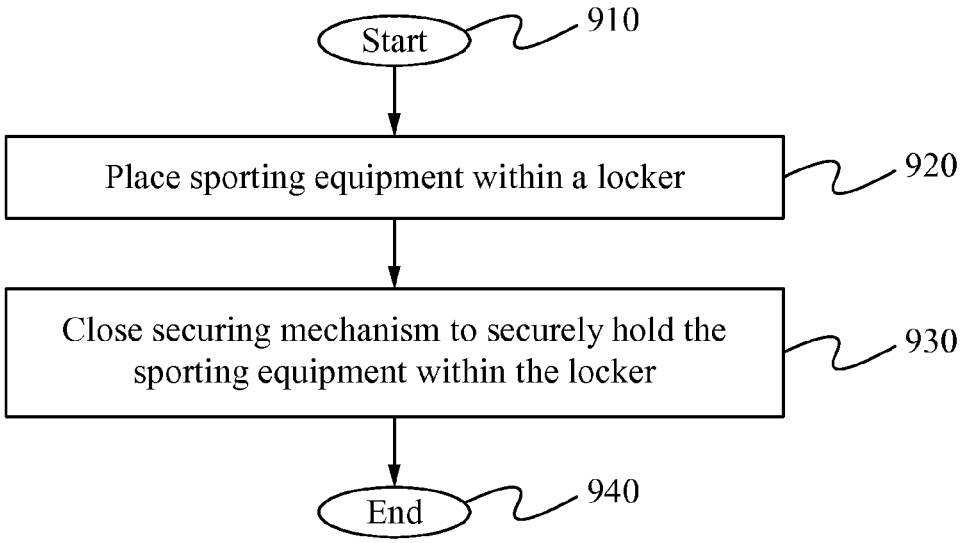
FIG. 9 illustrates a method of securing sports equipment in accordance with some embodiments.

FIG. 9 illustrates a method of securing sports equipment in accordance with some embodiments. The method starts in the step 910. In the step 920, an item of sports equipment is placed within a locker. In some embodiments, the sports equipment is one or more of a skateboard, a long board skate board, a pair of skis, a snowboard, and a scooter. Then, in the step 930, a securing mechanism is closed over a protruding portion of the sports equipment. In some embodiments, when the securing mechanism is closed, a portion of the sports equipment protrudes from the locker. In some embodiments, the portion of the sports equipment that protrudes from the locker, passes through a space in the locker body. The method ends in the step 940.

In operation, the device and system for securing sports equipment enables a person to securely store a long board skateboard, a skateboard, a scooter, a snowboard, and skis while not in use. Particularly, by placing a device for securing sports equipment at popular locations such as schools, malls, movie theaters, parks and ski areas, users are able to travel to a destination in an enjoyable and environmentally friendly manner and then store their mode of transportation securely and safely. By storing sports equipment in this manner, a user can then enjoy themselves without worrying if their sports equipment is secure and without carrying it with them. Accordingly, the device and system for securing sports equipment has many advantages.

The present invention has been described in terms of specific embodiments incorporating details to facilitate the understanding of principles of construction and operation of the invention. Such reference herein to specific embodiments and details thereof is not intended to limit the scope of the claims appended hereto. Particularly, it will be apparent to one skilled in the art that the parts of the device may be formed out of sheet metal, which may be formed using a manual or automated brake press. Further, the parts of the device may be formed by plastic injection molding. Additionally, the holes and shapes of the parts may be cut and drilled using hand tools and with a computer controlled machine. Such machines may use a punching, water jet, and laser cutting method of creating the holes and shapes.

Additionally, it will be readily apparent to one skilled in the art that other various modifications may be made in the embodiment chosen for illustration without departing from the spirit and scope of the invention as defined by the appended claims.

I claim:

1. An apparatus for securing a skateboard, the skateboard comprising an elongated board, a first wheel assembly and a second wheel assembly, the apparatus comprising:

a. a mounting base;

b. a locker body coupled to the mounting base for supporting the locker body in an upright position, the locker body comprising an open top, an open bottom enclosed by four fixed sides;

c. a support shelf positioned within the locker body and covering a portion of the open bottom to support at least one of the wheel assemblies when a skateboard is positioned within the locker body, wherein when a skateboard is positioned within the locker body and supported by the support shelf, a top portion of the elongated board above the first wheel assembly protrudes through the open top of the locker body, a bottom portion of the elongated board below the second wheel assembly protrudes through the open bottom of the locker body and the first wheel assembly, the second wheel assembly and central portion of the elongated board between the top portion and the bottom portion are all covered within the locker body; and d. a hinged top coupled to the open top of the locker body, the hinged top having an open position and a closed position, wherein when the hinged top is in the open position, a skateboard is able to only be inserted into and removed from the locker body through the open top, and when the hinged top is in the closed position, a skateboard is not able to be inserted into and removed from the locker body.

2. The apparatus of claim 1 further comprising a lock hole within the hinged top for securing the hinged top in the closed position when an external lock is positioned within the lock hole.

3. The apparatus of claim 1 further comprising a lock coupled to the locker body for locking the hinged top in the closed position.

4. The apparatus of claim 1 wherein the mounting base is coupled to a ground.

5. The apparatus of claim 1 wherein the mounting base is coupled to an object.

6. An apparatus for securing a plurality of skateboards, each skateboard comprising an elongated board, a first wheel assembly and a second wheel assembly, the apparatus comprising:

a. a mounting base;

b. a plurality of locker bodies each coupled to the mounting base for supporting the locker body in an upright position, each locker body comprising:

i. an open top;

ii. an open bottom wherein the open top and the open bottom are enclosed by four fixed sides;

iii. a support shelf positioned within the locker body and covering a portion of the open bottom to support at least one of the wheel assemblies when a skateboard is positioned within the locker body, wherein when a skateboard is positioned within the locker body and supported by the support shelf, a top portion of the elongated board above the first wheel assembly protrudes through the open top of the locker body, a bottom portion of the elongated board below the second wheel assembly protrudes through the open bottom of the locker body and the first wheel assembly, the second wheel assembly and central portion of the elongated board between the top portion and the bottom portion are all covered within the locker body; and v. a hinged top coupled to the open top of the locker body, the hinged top having an open position and a closed position, wherein when the hinged top is in the open position, a skateboard is able to only be inserted into and removed from the locker body through the open top, and when the hinged top is in the closed position, a skateboard is not able to be inserted into and removed from the locker body.

7. The apparatus of claim 6 wherein each locker body further comprises a lock hole within the hinged top for securing the hinged top in the closed position when an external lock is positioned within the lock hole.

8. The apparatus of claim 6 wherein each locker body further comprises a lock coupled to the locker body for locking the hinged top in the closed position.

9. The apparatus of claim 6 wherein the mounting base is coupled to a ground.

10. The apparatus of claim 6 wherein the mounting base is coupled to an object.

* * * * *